US006165333A

United States Patent [19]

Tanaka et al.

[11] Patent Number: 6,165,333

[45] Date of Patent: Dec. 26, 2000

[54] CATHODE ASSEMBLY AND METHOD OF REACTIVATION

[75] Inventors: Masashi Tanaka; Shuji Nakamatsu; Yoshinori Nishiki, all of Kanagawa, Japan

[73] Assignee: Permelec Electrode Ltd., Kanagwa, Japan

[21] Appl. No.: 09/419,904

[22] Filed: Oct. 18, 1999

[30] Foreign Application Priority Data

Oct. 16, 1998 [JP] Japan ..... 10-295606

[51] Int. Cl.[7] ..... C25B 11/00

[52] U.S. Cl. ..... 204/282; 204/252; 204/283; 205/637

[58] Field of Search ..... 204/252, 282, 204/283; 205/637

[56] References Cited

U.S. PATENT DOCUMENTS 4,787,964 11/1988 Gordon et al. ..... 204/282

4,980,037 12/1990 Hossain et al. ..... 204/252

5,879,521 3/1999 Shimamune et al. ..... 204/252

*Primary Examiner*—Bruce F. Bell

*Attorney, Agent, or Firm*—Sughrue, Mion, Zinn, Macpeak & Seas, PLLC

[57] ABSTRACT

A cathode assembly comprising a cathode, an ion-exchange membrane, and an electroconductive porous member permeable to gas and liquid sandwiched between the cathode and the membrane. The porous member may have, deposited on a part thereof, a catalyst active in hydrogen generation. The porous member preferably is in the form of a plate, sheet, fibers, web, paper, net, or sinter of any of these, and comprises at least a carbonaceous material and has a thickness of from 0.05 to 5 mm and a porosity of from 10 to 95%. Also disclosed is a method of reactivating a cathode assembly, which comprises conducting electrolysis using the cathode assembly until its activity decreases, and then depositing a catalyst active in hydrogen generation on the porous member.

20 Claims, 1 Drawing Sheet

CATHODE ASSEMBLY AND METHOD OF REACTIVATION

FIELD OF THE INVENTION

The present invention relates to a cathode assembly for use in industrial electrolysis and a method of reactivating the cathode assembly.

BACKGROUND OF THE INVENTION

Sodium hydroxide and chlorine are important industrial starting materials. These are produced mainly by the electrolysis of sodium chloride. Processes for the electrolysis of sodium chloride have shifted from the mercury process, in which a mercury cathode is used, and the diaphragm process, in which an asbestos diaphragm and a soft-iron cathode are used, to the ion-exchange membrane process, in which an ion-exchange membrane as a diaphragm and an activated cathode having a low overvoltage are used. During the course of these developments, the electric power consumption rate for the production of 1 ton of caustic soda has decreased to 2,000 kWh.

Examples of processes for producing an activated cathode active in hydrogen generation for use in the ion-exchange membrane process include: a method in which a ruthenium oxide powder is dispersed into a nickel plating bath and composite plating is conducted onto an electrode base to obtain an active electrode; a method in which a nickel deposit containing a second ingredient such as sulfur or tin is formed by plating; and a method in which NiO plasma spraying is used. Examples thereof further include method in which Raney nickel, an Ni—Mo alloy, a Pt—Ru deposit formed by displacement plating, or the like is used. An activated cathode is also known in which a hydrogen-absorbing alloy is used in order to impart resistance to reverse current.

These techniques are described in the following publications (1) to (4).

(1) *Electrochemical Hydrogen Technologies*, pp. 15–62 (1990)

(2) U.S. Pat. No. 4,801,368

(3) *J. Electrochem. Soc.*, 137, pp. 1419–1423 (1993)

(4) *Modern Chlor-Alkali Technology*, Vol. 3, pp. 250–262 (1986)

Recently, electrolytic cells which can be used in the ion-exchange membrane process at a heightened current density are being investigated in order to increase production capacity and reduce investment cost. Because low-resistance membranes have been developed, it has become possible to impose a high-density current load onto an electrode.

In the ion-exchange membrane process, the anode is usually an insoluble metal electrode (DSA). In view of the fact that DSA's have been used as anodes in the mercury process at current densities as high as up to 200 to 300 $A/dm^2$, use of a DSA in electrolysis by the ion-exchange membrane process at such a high current density seems to pose no problem with respect to the anode alone. However, it is still unknown that existing cathodes can be used because their useful life and performance characteristics have not been confirmed at such high current densities in real cells.

Specifically, the cathode for use in the ion-exchange membrane process needs to exhibit the following characteristics: a low overvoltage; no damage to the membrane even upon contact with the cathode; and reduced release of fouling ingredients, e.g., metal ions. If there is no cathode which has these properties, a conventionally used cathode (one having high surface roughness and a catalyst layer of low mechanical strength) is employed. Basically, however, certain measures are necessary for the use of such a conventional cathode. On the other hand, for realizing the new process in which electrolysis is conducted at a high current density, there is a need to develop an activated cathode which has the above characteristics and is sufficiently stable even under the above-described electrolysis conditions.

FIG. 2 diagrammatically shows the currently most common process for sodium chloride electrolysis using an activated cathode. In this sodium chloride electrolysis, a cathode 3 is disposed on the cathode side, i.e., on one side, of a cation-exchange membrane 1 so that it is in contact with the membrane (zero gap) or is apart therefrom to form a gap of up to 3 mm. An anode 2 is disposed on the other side of the cation-exchange membrane 1. On the catalyst layer of the cathode 3, water containing sodium chloride reacts to yield sodium hydroxide.

The anode and cathode reactions are as follows.

$$2Cl^- \rightarrow Cl_2 + 2e^- \ (1.36\ V)$$

$$2H_2O + 2e^- \rightarrow 2OH^- + H_2 \ (-0.83\ V)$$

The theoretical electrolytic potential is 2.19 V.

Conventional activated electrodes, when used in cell operation at a high current density, exhibit some serious problems which need to be solved as follows.

(1) Since the electrodes employ bases comprising nickel, iron, carbon, etc., these bases partly dissolve away as the electrodes deteriorate due to high current density. The dissolved base ingredients which have thus eluted into the catholyte move to the membrane and the anode chamber, leading to a decrease in product quality and impaired electrolytic performance.

(2) The overvoltage increases with increasing current density, resulting in reduced energy efficiency.

(3) As the current density becomes higher, the cell exhibits increased unevenness in the distribution of bubbles and in the concentration of the caustic soda that is produced. Hence, the catholyte exhibits an increased solution resistance loss.

It may be desirable to place the cathode 3 in contact with the ion-exchange membrane 1 such that there is no gap between the cathode material and the ion-exchange membrane, because this constitution should be effective in lowering the electrolytic voltage. However, because the cathode 3 has a rough surface, the cathode 3 may mechanically break the ion-exchange membrane 1 when used in contact therewith. Consequently, use of the conventional cathode 3 at a high current density in such a zero-gap constitution has been problematic.

If an existing cell needs almost no modification for efficient operation at both low and high current densities, this brings about a considerable economic advantage. On the other hand, when electrode deterioration has occurred, it is necessary to re-form the catalyst layer of the cathode. In many cases, however, this reactivation is technically or economically difficult.

SUMMARY OF THE INVENTION

Accordingly, an object of the present invention is to provide a cathode assembly which eliminates the above-described problems of the prior art, and which can be used in an electrolytic cell that is operated at a high current density.

Another object of the present invention is to provide a cathode assembly which eliminates the above-described problems of the prior art, and which can be used in electrolysis in an existing cell at a high current density.

The present invention achieves the above-described objectives by providing:

(1) A cathode assembly comprising a cathode, an ion-exchange membrane, and an electroconductive porous member permeable to gas and liquid sandwiched between the cathode and the membrane.

(2) The cathode assembly as described in (1) above, wherein the porous member comprises a catalyst active in hydrogen generation deposited on a part thereof.

(3) The cathode assembly as described in (1) above, wherein the porous member is in a form selected from the group consisting of a plate, sheet, fibers, web, paper, net and sinter of any of these, and comprises at least a carbonaceous material and has a thickness of from 0.05 to 5 mm and a porosity of from 10 to 95%.

(4) A method of reactivating a cathode assembly, which comprises conducting electrolysis using the cathode assembly of (1) above until its activity decreases and then deposition a catalyst active in hydrogen generation on the porous member.

[Description of Symbols]

Figure 1:
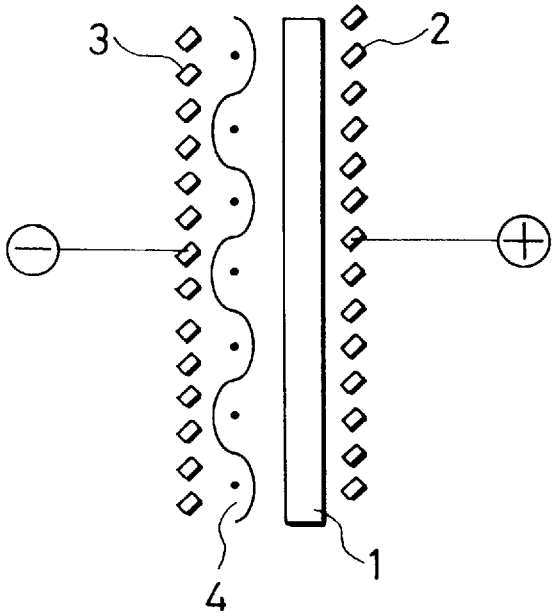
FIG. 1 is a view illustrating one embodiment of the cathode assembly according to the present invention.
Figure 2:
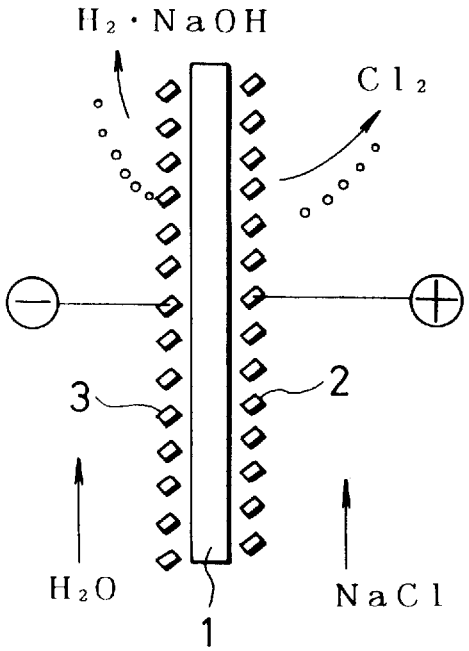
FIG. 2 PRIOR ART
FIG. 2 is a view diagrammatically illustrating a conventional process for the electrolysis of sodium chloride.

1 ion-exchange membrane
2 anode
3 cathode
4 porous member

DETAILED DESCRIPTION OF THE INVENTION

In the present invention, an electroconductive porous member having gas and liquid permeability is sandwiched between a cathode and an ion-exchange membrane. This arrangement prevents the cathode from contacting the membrane and hence from damaging the same.

For this purpose, the porous member should have a smooth surface so as not to damage the ion-exchange membrane even in contact therewith. Although spacers have been used for this purpose, such as nets made of synthetic fibers, the porous member for use in the present invention is electrically conductive unlike these spacers. Because of its conductivity and because it is in contact with the cathode, the porous member functions also as a conductive part of the cathode.

From the above standpoint, the porous member is preferably made of a corrosion-resistant material such as, e.g., titanium, nickel, zirconium, carbon, or silver. However, a carbonaceous material (especially, a graphitized material) is preferred from the standpoints of cost and chemical stability. An optimal form of the member is a sheet form having a thickness of from 0.05 to 5 mm and a porosity of from 10 to 95%.

It is, however, noted that although the porous member is in direct contact with the ion-exchange membrane, the cathode reaction proceeds on the cathode. This is because the cell has a high hydrogen overvoltage due to the material constituting the porous member.

Interposing the porous member between the ion-exchange membrane and the cathode prevents fine particles which have been generated as a result of cathode deterioration or dissolved ingredients which have been released from a nickel base from directly penetrating into the membrane. Furthermore, this structure inhibits fouling of the membrane by the particles or the nickel base.

Furthermore, when a catalyst which accelerates hydrogen generation is deposited on the porous member made of a conductive material such as those enumerated above, the porous member assumes the same potential as the cathode. This porous member can then function as part of the cathode.

Although the catalyst can be deposited on the porous member prior to conducting electrolysis, it is exceedingly preferred to deposit the catalyst at a time when the activity of the cathode has decreased as a result of electrolysis. This is because the cathode assembly including the cathode can thus be reactivated to advantageously minimize fluctuations of electrolytic voltage in the electrolysis equipment.

Where the porous member is made of carbon, it is possible to deposit a catalyst on the carbonaceous member as described above. A carbonaceous member having a catalyst, or having a compound of a catalyst element, deposited thereon can be formed by a pyrolysis method.

Preferred examples of the catalyst include platinum group metals such as silver, palladium, ruthenium, and iridium and alloys containing any of these metals. Examples thereof further include cobalt, a combination of cobalt with either a platinum group metal or an alloy thereof, and a combination of cobalt with an oxide of a platinum group metal.

One embodiment of the present invention will be explained below, but the invention should not be construed as being limited thereto.

FIG. 1 is a view illustrating one embodiment of the cathode assembly of the present invention. This catalyst assembly has an electroconductive porous member 4 permeable to gas and liquid sandwiched between a cathode 3 and an ion-exchange membrane 1.

The sandwiched porous member 4 is preferably made of a carbonaceous material (especially, a graphitized material) from the standpoints of cost and chemical stability. An optimal form of the member is a sheet form having a thickness of from 0.05 to 5 mm and a porosity of from 10 to 95%.

This sheet form material as the porous member 4, i.e., electrode sheet 4, preferably retains moderate porosity from the standpoints of passing an electric current through the cell and supplying or removing gases or liquids.

The electrode sheet 4 has regions made of a hydrophobic material and regions made of a hydrophilic material so as to enable the smooth movement of an electrolyte, etc. Preferably, these materials are scatteringly deposited on a catalyst or on a catalyst-bearing collector.

Examples of the hydrophobic material for use with the hydrophilic material include pitch fluoride, graphite fluoride, and fluororesins. Especially in the case of fluororesins, a burning step is preferably conducted at a temperature of from 200 to 400° C. in order to obtain satisfactory performance and evenness thereof.

Porous carbon materials generally possess hydrophilic groups on the surface, such as quinone, ketone. To ensure the hydrophilicity, thermal treatment in atmosphere is effective. In this case, it is better way to form metal or metal oxide layer by thermal decomposition of the coating solution having silver, titanium and etc., as written in Example 1.

The hydrophobic and hydrophilic regions each preferably extends continuously along the direction of the electrode thickness. Namely, each side of the electrode sheet is mottled with respect to hydrophilicity and hydrophobicity. This mottle preferably has the following constitution. The hydrophilic material which is exposed on one side of the electrode sheet to constitute hydrophilic spots thereon is mostly distributed so as to extend in the sheet thickness direction to form, on the opposite side, hydrophilic spots of the same pattern in almost the same positions. Also, the hydrophobic material which is exposed on one side of the electrode sheet to constitute hydrophobic spots is likewise distributed so as to extend in the sheet thickness direction to form, on the opposite side, hydrophobic spots of the same pattern in almost the same positions.

Where the cathode assembly having such a constitution has deteriorated in performance as a result of, e.g., the electrolysis of sodium chloride, and requires reactivation, a catalyst layer may be formed on the porous material as needed so that the cathode assembly can be continuously used. Preferred examples of the catalyst include metals such as platinum, palladium, ruthenium, iridium, silver, and cobalt and oxides of these metals.

The catalyst is powdered and mixed with a binder, e.g., a fluororesin, or with a solvent, e.g., naphtha, to prepare a paste, which is applied to the porous material to fix the catalyst thereto. Other usable catalyst deposition methods include a method in which a solution of a salt of a catalyst metal is applied to the base surface and the resultant coating is burned. Also usable is a method in which the salt solution is subjected to electroplating or to electroless plating in the presence of a reducing agent.

A preferred method for uniting the porous member 4 with an electrode main body is to superpose the porous material on a current collector or feeder (this corrector was used as a cathode in previous cell) and to press them together at a pressure of from 0.1 to 30 kg·f/cm$^2$. If a sufficient bonding strength cannot be obtained by mere pressing, the porous member is preferably fixed to the feeder prior to assembling the cell. The sheet preferably has a thickness of from 0.1 to 5 mm and a porosity of from 10 to 95%.

When the electrode of the present invention is used for the electrolysis of sodium chloride, an optimal ion-exchange membrane is a fluororesin membrane from the standpoint of corrosion resistance. The anode 3 is preferably a titanium-based insoluble electrode which has an oxide of a noble metal and is called a DSA. This DSA is preferably porous so that it can be used in contact with the membrane. In the case where the electrode of the present invention needs to be in close contact with the membrane, they may be mechanically bonded to each other prior to assembling the cell. It is, however, sufficient to apply pressure on the electrode during electrolysis. The pressure is preferably from 0.1 to 30 kg·f/cm$^2$. Preferred electrolysis conditions include a temperature of from 10 to 90° C. and a current density of from 20 to 100 A/dm$^2$.

The present invention will be explained below in more detail by reference to the following Examples, but the invention should not be construed as being limited thereto.

EXAMPLE 1

A cell having an electrolysis area of 1 dm$^2$ (width, 5 cm; height, 20 cm) was used. An electroconductive porous member to be disposed between a membrane and a cathode was produced by applying an aqueous silver nitrate solution onto the surface of a carbon cloth (PWB, manufactured by Zoltek) as a base and then pyrolyzing the coating in an inert atmosphere at 350° C. to deposit silver particles on the surface of the porous member (10 g/m$^2$).

A nickel mesh (8 mm LW, 6 mm SW, 1 mm T; conventionally used as a cathode) was used as a cathode base. After the surface of the base was roughened and etched with hydrochloric acid, it was plated in a nickel electrodeposition bath containing a powdery $RuO_2$ catalyst dispersed therein to form on the base surface a deposit containing catalyst particles. This plated nickel mesh was used as a cathode.

A porous DSA made of titanium was used as an anode. Nafion 981 (manufactured by E.I. du Pont de Nemours & Co.) was used as an ion-exchange membrane. The electrodes and the porous member were brought into close contact with opposing sides of the ion-exchange membrane to fabricate an electrode cell having a cathode compartment and an anode compartment. Saturated aqueous sodium chloride solution was supplied as an anolyte at a rate of 4 ml/min, while pure water was supplied to the cathode chamber at a rate of 0.5 ml/min. A current of 50 A was passed through the cell at a temperature of 90° C. As a result, the cell voltage was 3.35 V, and a 32 wt % NaOH solution was obtained from the cathode outlet at a current efficiency of 96%. Electrolysis was conducted for 30 days under these conditions while suspending the operation for 1 day every week. Throughout the 30-day electrolysis, the cell voltage increased by 10 mV but the current efficiency of 96% was maintained. The cell was disassembled and the membrane was then analyzed. As a result, no deposition of nickel or the like was observed.

EXAMPLE 2

A cell was fabricated in the same manner as in Example 1, except that the carbon cloth (PWB, manufactured by Zoltek) was used as a porous member without undergoing any treatment. A current of 50 A was passed through the cell. As a result, the cell voltage was 3.40 V, and a 32 wt % NaOH solution was obtained from the cathode outlet at a current efficiency of 96%. Electrolysis was conducted for 30 days under the same conditions. Through the 30-day electrolysis, the cell voltage increased by 20 mV but the efficiency of 96% was maintained. The cell was disassembled and the membrane was then analyzed. As a result, no deposition of nickel or the like was observed.

Comparative Example

A cell was fabricated in the same manner as in Example 1, except that the porous member was omitted. A current of 50 A was passed through the cell. As a result, the cell voltage was 3.30 V, and a 32 wt % NaOH solution was obtained from the cathode outlet at a current efficiency of 96%. Electrolysis was conducted for 30 days under the same conditions. Through the 30-day electrolysis, the cell voltage increased by 50 mV and the efficiency decreased to 94%. The cell was disassembled and the membrane was then analyzed. As a result, the membrane was found to have partly browned, and the deposition of nickel was observed.

The present invention brings about the following effects. Since the cathode assembly provided by the present invention has an electroconductive porous member permeable to gas and liquid sandwiched between a cathode and an ion-exchange membrane, it can be an activated cathode assembly which eliminates the problems of prior art techniques and which can be used in an electrolytic cell operated at a high current density.

The electrolytic performance of the cathode assembly can be improved by depositing a catalyst on the porous member. This enables an existing cell to be operated at a high current density without undergoing any modification.

The present invention provides a significant economic advantage because an existing conventional cell is readily adapted to utilize the inventive cathode assembly. Interposing the porous material enables even contact between the ion-exchange membrane and the cathode, whereby the current distribution in a large cell is improved.

Furthermore, when the cathode assembly of the present invention exhibits deteriorated performance during the course of operation, it can be reactivated according to the present invention by merely inserting a porous material having a catalyst deposited thereon, unlike conventional cathodes which are generally reactivated by re-forming a catalyst layer thereon. Consequently, there is no need to conduct a reactivation step which is technically or economically difficult. Therefore, the present invention also has a high industrial value.

While the invention has been described in detail and with reference to specific embodiments thereof, it will be apparent to one skilled in the art that various changes and modifications can be made therein without departing from the spirit and scope thereof.

What is claimed is:

1. A cathode assembly comprising a cathode, an ion-exchange membrane, and an electroconductive porous member permeable to gas and liquid sandwiched between the cathode and the membrane.

2. The cathode assembly of claim 1, wherein the porous member comprise's a catalyst active in hydrogen generation deposited on part thereof.

3. The cathode assembly of claim 2, wherein the catalyst comprises a material selected from the group consisting of cobalt, a combination of cobalt with either a platinum group metal or an alloy thereof and a combination of cobalt with an oxide of a platinum group metal.

4. The cathode assembly of claim 2, wherein the catalyst comprises a material selected from the group consisting of platinum, palladium, ruthenium, iridium, silver, cobalt and oxides of these metals.

5. The cathode assembly of claim 1, wherein the porous member is in a form selected from the group consisting of a plate, sheet, fibers, web, paper, net and sinter of any of these, and comprises at least a carbonaceous material and has a thickness of from 0.05 to 5 mm and a porosity of from 10 to 95%.

6. The cathode assembly of claim 1, wherein the porous member is in the form of a sheet, and one side of the porous member is in direct contact with the ion-exchange membrane.

7. The cathode assembly of claim 1, wherein the porous member comprises at least one electroconductive material selected from the group consisting of titanium, nickel, zirconium, carbon and silver.

8. The cathode assembly of claim 1, wherein the porous member comprises hydrophobic regions and hydrophilic regions.

9. The cathode assembly of claim 8, wherein said hydrophobic regions comprise a hydrophobic material selected from the group consisting of pitch fluoride, graphite fluoride and fluororesins.

10. The cathode assembly of claim 8, wherein the porous member is in the form of a sheet, and said hydrophobic regions and hydrophilic regions extend continuously along the thickness direction of the sheet.

11. The cathode assembly of claim 10, wherein said hydrophobic regions and hydrophilic regions are formed in a pattern on one side of the porous membrane and said hydrophobic regions and hydrophilic regions are formed in the same pattern on the other side of the porous membrane.

12. The cathode assembly of claim 1, wherein said porous member comprises a carbon cloth and a silver particles deposited on a surface of the cloth.

13. The cathode assembly of claim 12, wherein said porous member comprises a carbon cloth and a pyrolyzed coating of a silver nitrate solution applied to said cloth.

14. An electrolytic cell partitioned into at least an anode chamber including an anode and a cathode chamber including a cathode with a cathode assembly comprising said cathode, an ion-exchange membrane, and an electroconductive porous member permeable to gas and liquid sandwiched between the cathode and the membrane.

15. The electrolytic cell of claim 14, wherein the porous member comprises a catalyst active in hydrogen generation deposited on a part thereof.

16. The electrolytic cell of claim 14, wherein the porous member is in a form selected from the group consisting of a plate, sheet, fibers, web, paper, net and sinter of any of these, and comprises at least a carbonaceous material and has a thickness of from 0.05 to 5 mm and a porosity of from 10 to 95%.

17. The electrolytic cell of claim 14, wherein the porous member is in the form of a sheet, and one side of the porous member is in direct contact with the ion-exchange membrane.

18. A method of reactivating a cathode assembly, which comprises conducting electrolysis using a cathode assembly having hydrogen generation activity until its activity decreases, and then depositing a catalyst active in hydrogen generation on the porous member, wherein said cathode assembly comprises a cathode, an ion-exchange membrane, and an electroconductive porous member permeable to gas and liquid sandwiched between the cathode and the membrane.

19. The method of claim 18, wherein a catalyst active in hydrogen generation is not present on the porous member at the start of electrolysis.

20. The method of claim 18, wherein the porous member is in the form of a sheet, and one side of the porous member is in direct contact with the ion-exchange membrane.

* * * * *